United States Patent [19]

Wang

[11] Patent Number: 5,031,499

[45] Date of Patent: Jul. 16, 1991

[54] DRUM

[76] Inventor: J. S. Wang, No. 9-3, Hai Wei Tzu Lane, Chang-Yang Rd., Lung-Ching Hsiang, Taichung Hsien, Taiwan

[21] Appl. No.: 502,531

[22] Filed: Mar. 30, 1990

[51] Int. Cl.[5] ..... G10D 13/02

[52] U.S. Cl. ..... 84/411 M; 84/413

[58] Field of Search ..... 84/411 R, 411 M, 413

[56] References Cited

U.S. PATENT DOCUMENTS

| | | | |
|---|---|---|---|
| 1,597,026 | 8/1926 | Egermayer | 84/411 R |
| 3,421,400 | 1/1969 | Yokoi | 84/411 R |
| 4,325,281 | 4/1982 | Hardy | 84/411 M |
| 4,754,683 | 7/1988 | Townsend et al. | 84/413 |

FOREIGN PATENT DOCUMENTS

| | | | |
|---|---|---|---|
| 2161973 | 1/1986 | United Kingdom | 84/411 M |

*Primary Examiner*—Lawrence R. Franklin

*Attorney, Agent, or Firm*—Michael N. Meller

[57] ABSTRACT

A drum includes a hollow drum body, a drum skin frame supported by the walls of the hollow drum body, a drum skin stretched on the drum skin frame, and a drum head frame tightly clamping the peripheral; edges of the drum skin frame and the drum skin. A damping member, disposed between the drum head frame and the drum skin frame, absorbs the vibrations of the two drum frames and filters out the sound they produce whenever the drum skin is beaten.

1 Claim, 3 Drawing Sheets

DRUM

BACKGROUND OF THE INVENTION

The invention relates to drum, more particularly to a drum which includes provisions for damping vibrations coming from the drum head frame and the drum skin frame. Referring to FIG. 1, a drum head frame 20' and a drum skin frame 30' are disposed on an open end of a hollow body 10' of a conventional drum. The drum skin frame 30' is supported by the wall of the hollow body 10'. The drum head frame 20' is tightly clamped to the drum skin frame 30' by a locking member 12' having a threaded end received by screw sockets 11' formed surrounding the outer surface of the same. A drum skin 31' is tightly stretched on the drum skin frame 30'. When the locking member 12' is adjusted, the peripheral edge of the drum skin 31' is tightly pressed by the drum skin frame 30' and the drum head frame 20'. Both the drum skin frame 30' and the drum head frame 20' are made of metal. Whenever the drum skin 31' is beaten, the vibration of the drum skin 31' correspondingly vibrates the drum skin frame 30' and the drum head frame 20'. The sound coming from the drum thus includes sound produced by the vibrations of the two drum frames 20', 30'.

SUMMARY OF THE INVENTION

Therefore, the object of this invention is to provide a drum which has provisions for damping vibrations coming from the drum head frame and the drum skin frame whenever the drum skin is beaten.

Accordingly, a drum of this invention includes a drum head frame, a drum skin frame, and a drum skin stretched on the drum skin frame. A damping member is disposed between the drum head frame and the drum skin frame. The damping member has a flange portion which contacts the peripheral edge of the drum skin and acts as a partition between the two drum frames. Whenever the drum skin is beaten, the damping member acts to absorb the vibrations of the two drum frames and filters out the sound produced by them.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
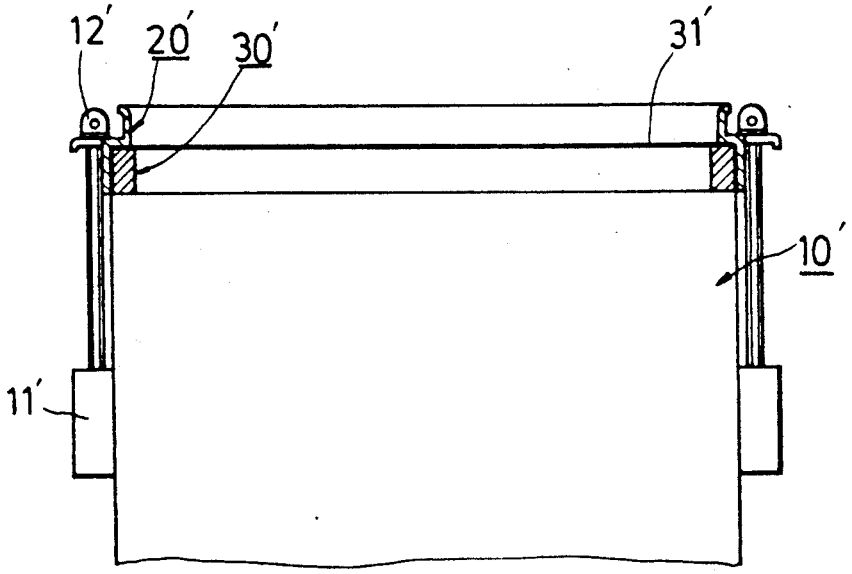
FIG. 1 PRIOR ART
FIG. 1 is a partially sectional view of prior art.
Figure 2:
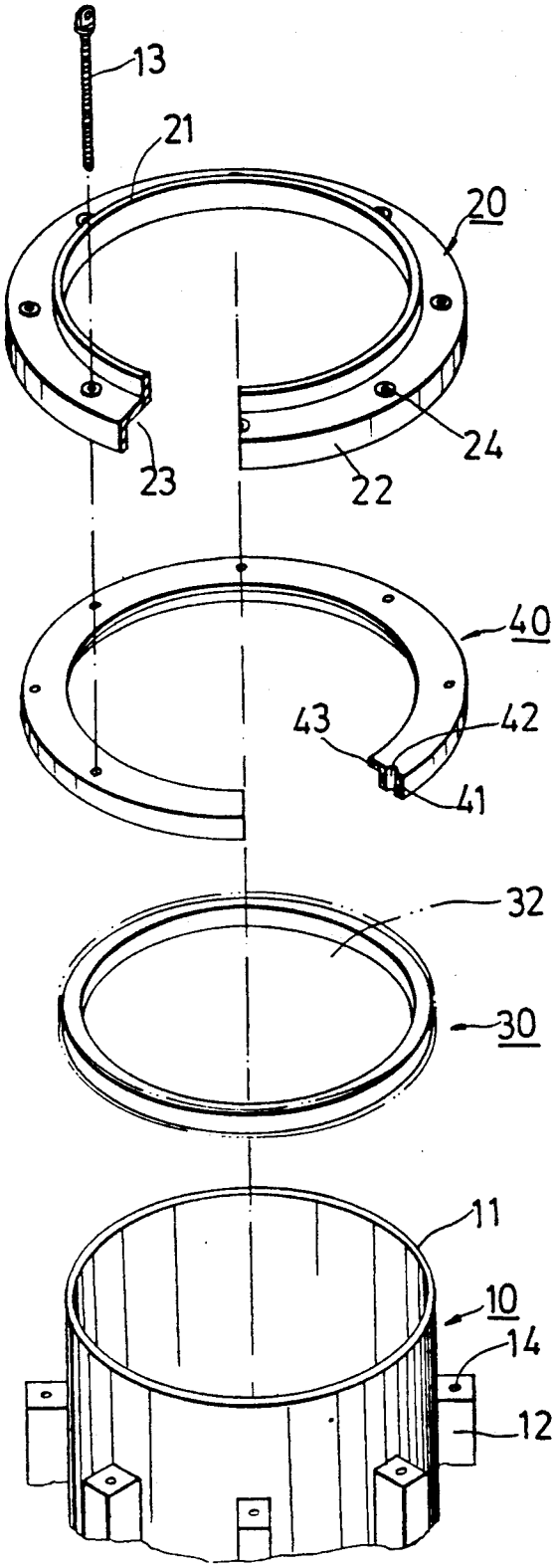
FIG. 2 is an exploded view of a drum according to this invention.

Referring to FIG. 2, a drum according to this invention comprises a hollow body 10, two drum head frames 20, two drum skin frames 30, and two damping members 40.

The hollow body 10 is cylindrical in shape, with two open ends 11 and a plurality of axial screw sockets 12 surrounding the outer wall of the same. Each of the screw sockets 12 has an axial screw hole 14 formed therein for receiving a locking member 13.

One drum head frame 20 is attached to each of the open ends of the hollow body 10. Each drum head frame 20 is formed as circular shoulder 23 with a central hole formed therein. Each drum head frame 20 further comprises an annular projection 21 which projects axially upward and is formed at the peripheral edge surrounding the central hole. A looped ring projection 22, which projects axially downward, is formed at the outer peripheral edge of the circular shoulder 23. A plurality of spaced holes 24 formed on the circular shoulder 23 receives the plurality of locking members 13.

Each of the two drum skin frames 30 is shaped as an annular ring base. Each drum skin frame 30 is disposed inside the ring projection 22 of the drum head frame 20. The diameter of the drum head frame 20 is larger than that of the drum skin frame 30, forming an annular clearance 31. A drum skin 32 is tightly stretched on each drum skin frame 30.

Each of the two damping members 40 is disposed inside the annular clearance 31. Each damping member 40 is also formed as an annular ring base 41. A plurality of spaced axial screw holes 42 receive the plurality of locking members 13. Each damping member 40 further comprises an inwardly and radially projecting endless flange member 43.

Figure 3:
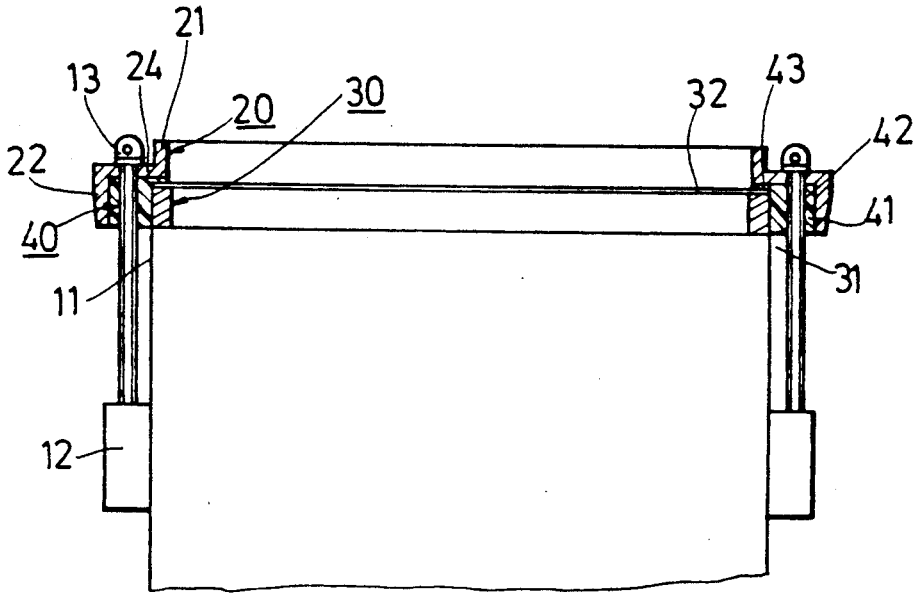
FIG. 3 is a partially sectional view of the preferred embodiment in FIG. 2.

FIG. 3 illustrates the preferred embodiment in its assembled form. Each locking member 13 is worn through one of the spaced holes 24 of the drum head frame 20, one of the screw holes 42 of the damping member 40 and through one of the axial screw holes 14 of the hollow body 10. The locking members 13 are adjusted so that the drum skins 32 are tightly pressed by the flange member 43 of the damping members 40 against the drum skin frame 30 and the hollow body 10. The damping members 40 are made of a resilient material and absorb any vibration of the drum head frames 20 and the drum skin frames 30. However, the vibration of the drum skin 32 is undisturbed.

When assembled, the ring projection 22 of the drum head frame 20 tightly contacts with the annular ring base 41 of the damping member 40. The drum skin frame 30 is supported by the walls of the hollow body 10. The inner surface of the annular ring base 41 is glued to the outer surface of the drum skin frame 30. A tight sealing effect is thus achieved between the drum head frame 20 and the drum skin frame 30.

When the drum skin 32 is beaten, it vibrates to generates a booming sound. Any vibrations which may come from the drum skin frame 30 and/or the drum head frame 20 are absorbed by the damping member 40. The sound output of a drum according to this invention is thus pure and unaffected by the vibrations of the drum skin frame 30 and the drum head frame 20. Isolation between the drum skin frame 30 and the drum head frame 20 is also achieved.

While the present invention has been described in connection with what is considered the most practical and preferred embodiment, it is understood that the invention is not limited to the disclosed embodiments, but is intended to cover various arrangements included within the spirit and scope of the broadest interpretation so as to encompass all such modifications and equivalent arrangements.

I claim:

1. A drum, comprising:

a hollow body with a top open end;

a looped drum skin frame in contact with said top open end of said hollow body;

a drum skin having a peripheral edge, said drum skin being tightly stretched on said drum skin frame;

a looped drum head frame provided at said top open end above said drum skin frame, said drum head frame being screwed to said hollow body for tightly clamping the peripheral edge of said drum skin and said drum skin frame against said hollow body, said drum head frame having a looped projection around said drum skin frame and a shoulder inwardly projecting from said looped projection above the peripheral edge of said drum skin; and a damping member made of a resilient material and being disposed between said drum skin frame and said drum head frame for providing isolation between said drum skin frame and said drum head frame, said damping member having a flange member between the peripheral edge of said drum skin and said shoulder of said drum skin head frame;

whereby, said damping member absorbs vibrations of said drum skin frame and drum head frame when said drum skin is beaten.

* * * * *